US007381884B1

(12) United States Patent
Atakhanian

(10) Patent No.: US 7,381,884 B1
(45) Date of Patent: Jun. 3, 2008

(54) SOUND GENERATING HAND WEAR

(76) Inventor: Yourik Atakhanian, 48 Royal Park Ter., Hillsdale, NJ (US) 07642

( * ) Notice: Subject to any disclaimer, the term of this patent is extended or adjusted under 35 U.S.C. 154(b) by 124 days.

(21) Appl. No.: 11/366,910

(22) Filed: Mar. 3, 2006

(51) Int. Cl.
*G10H 3/00* (2006.01)

(52) U.S. Cl. ..... 84/723; 84/735; 84/737; 84/477 R; 84/485 R

(58) Field of Classification Search ..... None
See application file for complete search history.

(56) References Cited

U.S. PATENT DOCUMENTS

| | | | | |
|---|---|---|---|---|
| 4,635,516 A | | 1/1987 | Giannini | |
| 4,905,560 A | | 3/1990 | Suzuki et al. | |
| 4,920,848 A | | 5/1990 | Suzuki | |
| 5,151,553 A | | 9/1992 | Suzuki et al. | |
| 5,166,462 A | * | 11/1992 | Suzuki et al. | 84/600 |
| 5,166,463 A | * | 11/1992 | Weber | 84/600 |
| 5,290,964 A | * | 3/1994 | Hiyoshi et al. | 84/600 |
| D347,853 S | | 6/1994 | Masubuchi et al. | |
| 6,420,640 B2 | | 7/2002 | Koch | |
| 2007/0226807 A1 | * | 9/2007 | Ginter et al. | 726/27 |

* cited by examiner

*Primary Examiner*—Marlon T Fletcher

(57) ABSTRACT

A glove includes a body that is positional about a user's hand. Speakers are embedded within the body and are coupled to the amp. Mechanisms are included for sensing external forces on each finger and for generating control signals when the external forces are detected. Each control signal includes an embedded digital data stream identifying an intensity and a time interval of the external forces. A mechanism is included for calculating a signal pattern corresponding to the control signal data streams. The signal pattern has the identical intensity and time interval characteristics of the external forces. LEDs are coupled to the signal pattern calculating mechanism. A mechanism is included for emitting musical sounds based upon the calculated signal pattern such that the audible musical sounds match the intensity and time interval of the signal pattern. The audible musical sound emitting mechanism includes an amp and a switch coupled thereto.

10 Claims, 4 Drawing Sheets

SOUND GENERATING HAND WEAR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to sound generating devices and, more particularly, to a sound generating hand wear device for generating and emitting musical sounds.

2. Prior Art

The generation of sounds in conventional musical instruments, such as a piano, an electronic organ, a guitar, a flute, or the like, is controlled by operating a keyboard, plucking strings, or blowing a pipe. These conventional musical instruments, however, may restrict the location of performance and/or the posture of the performer. For example, pianos and electronic organs are too large to be carried, so it is impossible for a performer to move his body with the instrument freely during a performance. Guitars and wind instruments can be carried and so do not restrict the location of performance, but they can limit the posture of a performer because these instruments must be hand-held. Thus, unencumbered movement by a performer during performance cannot be expected using conventional instruments.

A tone generating glove that includes switches and a tone generating circuit has been proposed in the prior art. In such a glove the switches are connected to the tone generating circuit, and both the switches and the tone generating circuit are mounted in the glove. The tone generating circuit produces a tone or tones in response to the actuation of one or more of the switches. Preferably, a switch is positioned at each finger joint of the glove, and the tone generating circuit produces a different tone in response to the actuation of each different switch. In other words, each of the switches uniquely corresponds to each of the tones. Thus, the musical tones are controlled by the bending of fingers.

This device, worn on the hand, makes it possible for a performer to enjoy the generation of musical tones in response to hand movement because the musical tones are controlled merely by bending the fingers, which does not hinder other motions of the body. However, the device does have various disadvantages as shown herein below. Unfortunately, the device cannot accurately respond to the bending of fingers. This is because each switch and other components are not interconnected and are individually attached to the glove, so that the bending of one finger causes sagging on a part of the glove, which hinders the maintenance of contact of the other switches corresponding to the other digits. Furthermore, a performer cannot achieve the expressive musical performance which the performer wishes for. This is because the device can only generate musical tones in response to ON/OFF signals of the switches, and cannot control tone volumes, tone colors, sound effects, etc. in response to the signals of the switches.

Accordingly, a need remains for a sound generating hand wear device in order to overcome the above-noted shortcomings. The present invention satisfies such a need by providing sound generating hand wear that is easy to use, light weight and durable in design, is reasonably priced and has great entertainment value for persons of all ages. Such a sound generating hand wear device allows an individual to create musical and rhythmic patterns by simply tapping their fingers on any suitable surface. This not only provides a fun, inventive, and entertaining novelty item, but also helps individuals who have little or no musical training to create melodies and musical/rhythmic phrases. The sound generating hand wear is also a convenient training and practice aid, and provides for a novel way to train inexperienced and novice musicians about the importance of rhythm.

BRIEF SUMMARY OF THE INVENTION

In view of the foregoing background, it is therefore an object of the present invention to provide a sound generating hand wear device. These and other objects, features, and advantages of the invention are provided by a glove worn by a user for generating and emitting musical sounds, notes, rhythms and melodies.

The glove includes a body that is removably positional about a hand of the user such that each finger of the user's hand is effectively able to freely move in multiple planes. A mechanism is included for sensing a plurality of external forces on each of the user fingers. Such a sensing mechanism is located partially external of the body. The external force sensing mechanism preferably includes a plurality of sensors that include potentiometers directly coupled to fingers tips of the body in such a manner that each of the finger tips includes first, second and third ones of the sensors. Fourth ones of the sensors are located on knuckle regions of the body. Fifth ones of the sensors are located on a palm region of the body such that the user can simultaneously bias the finger tips of the body and directly contact the first, second and third ones of the sensors with the fourth and fifth ones of the sensors and thereby effectively modify the audible musical sounds accordingly.

Another mechanism is included for sequentially generating a plurality of control signals when the sensing mechanism detects the external forces. Each of the control signals includes an embedded digital data stream identifying an intensity and a time interval of the external forces detected by the sensing mechanism. The sequential generating mechanism may include a plurality of controls that are electrically coupled directly to the sensors respectively. A plurality of switches are electrically coupled directly to the controls respectively. An analog-to-digital converter is electrically coupled to the controls. Such an analog to digital converter effectively converts an analog wave pattern of the control signals to a digital numeric pattern corresponding to the digital data stream. Each of the controls toggles the switches between open and closed positions based upon detection of the intensity and time interval characteristics of the external forces such that the control signals are sequentially coordinated with the external forces.

A further mechanism is included for calculating a signal pattern corresponding to the control signal data streams. Such a signal pattern has identical intensity and time interval characteristics of the external forces. A plurality of LEDs are electrically coupled to the signal pattern calculating mechanism. The signal pattern calculating mechanism preferably includes a digital signal processor electrically coupled directly to the analog to digital converter. A memory includes software instructions that cause the digital signal processor to compress groups of the digital data streams. Such software instructions execute a logic algorithm that includes the steps of identifying unique data packets from the digital data stream, grouping the unique data packets into separate batches, and storing the batches in retrievable memory zones such that the batches can advantageously and effectively be sequentially accessed during real-time playing conditions.

A mechanism is also included for emitting a plurality of audible musical sounds based upon the calculated signal pattern such that the audible musical sounds match the intensity and time interval of the signal pattern and thereby effectively permit the user to adjust the audible musical sounds by controlling real time intensity and time intervals of the external forces applied to the sensors respectively. The audible musical sound emitting mechanism includes an amp and a switch electrically coupled thereto. A plurality of speakers are embedded within the body and are directly coupled to the amp. The audible musical sound emitting mechanism may include a musical signal generating device that is electrically coupled to the memory. Such a musical signal generating device selectively extracts and uncompresses selected ones of the batches when corresponding ones of the external forces are detected. A sound interface device is electrically coupled directly to the musical signal generating device and directly receives the uncompressed batches therefrom. A plurality of transducers are electrically coupled to the sound interface device and emits the audible musical sounds based upon unique sounds associated with the batches respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
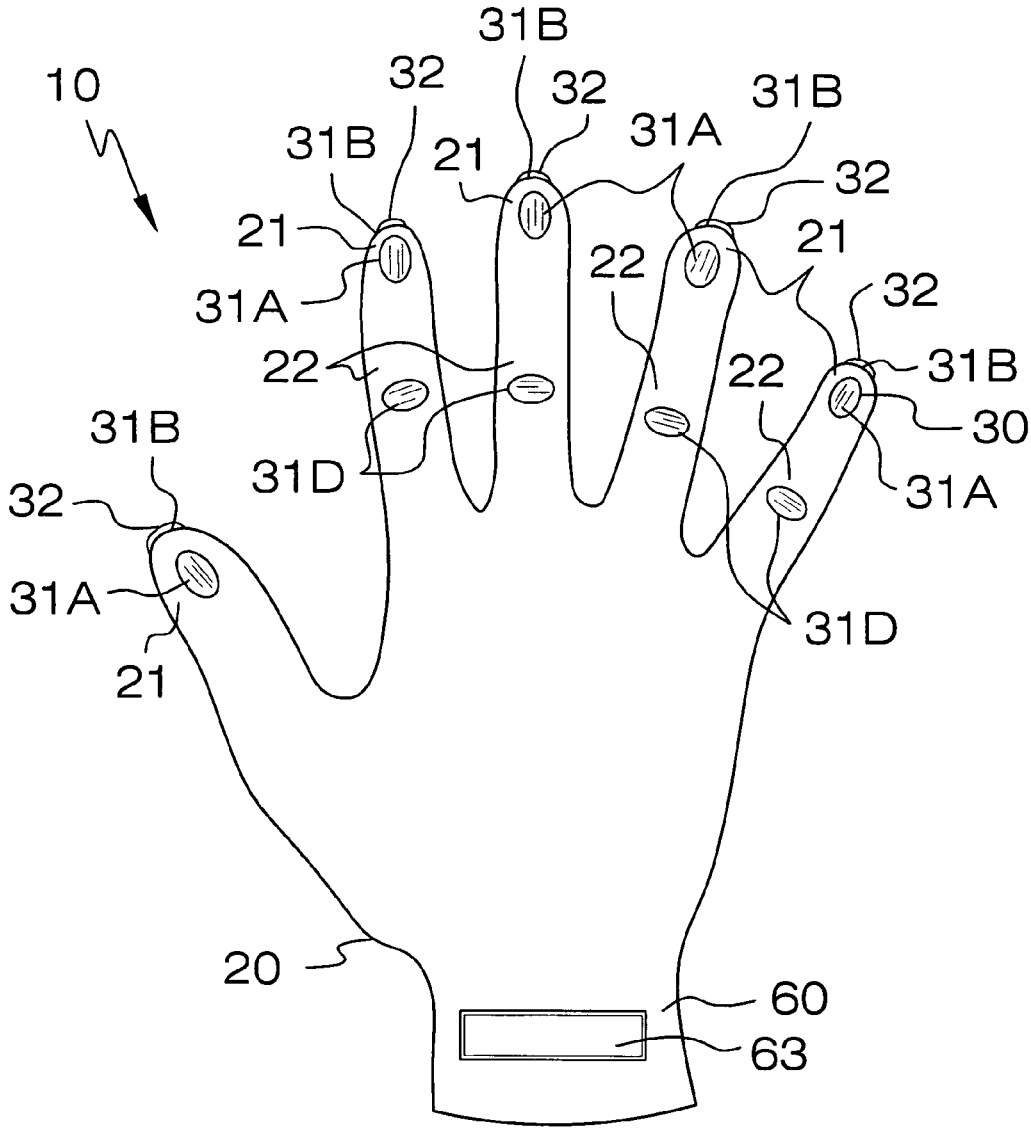
FIG. 1 is a top plan view showing a sound generating hand wear device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-4 by the reference numeral 10 and is intended to provide sound generating hand wear. It should be understood that the device 10 may be used to produce many different types of musical sounds and should not be limited to only producing the sound and melodies associated with a single instrument.

Figure 2:
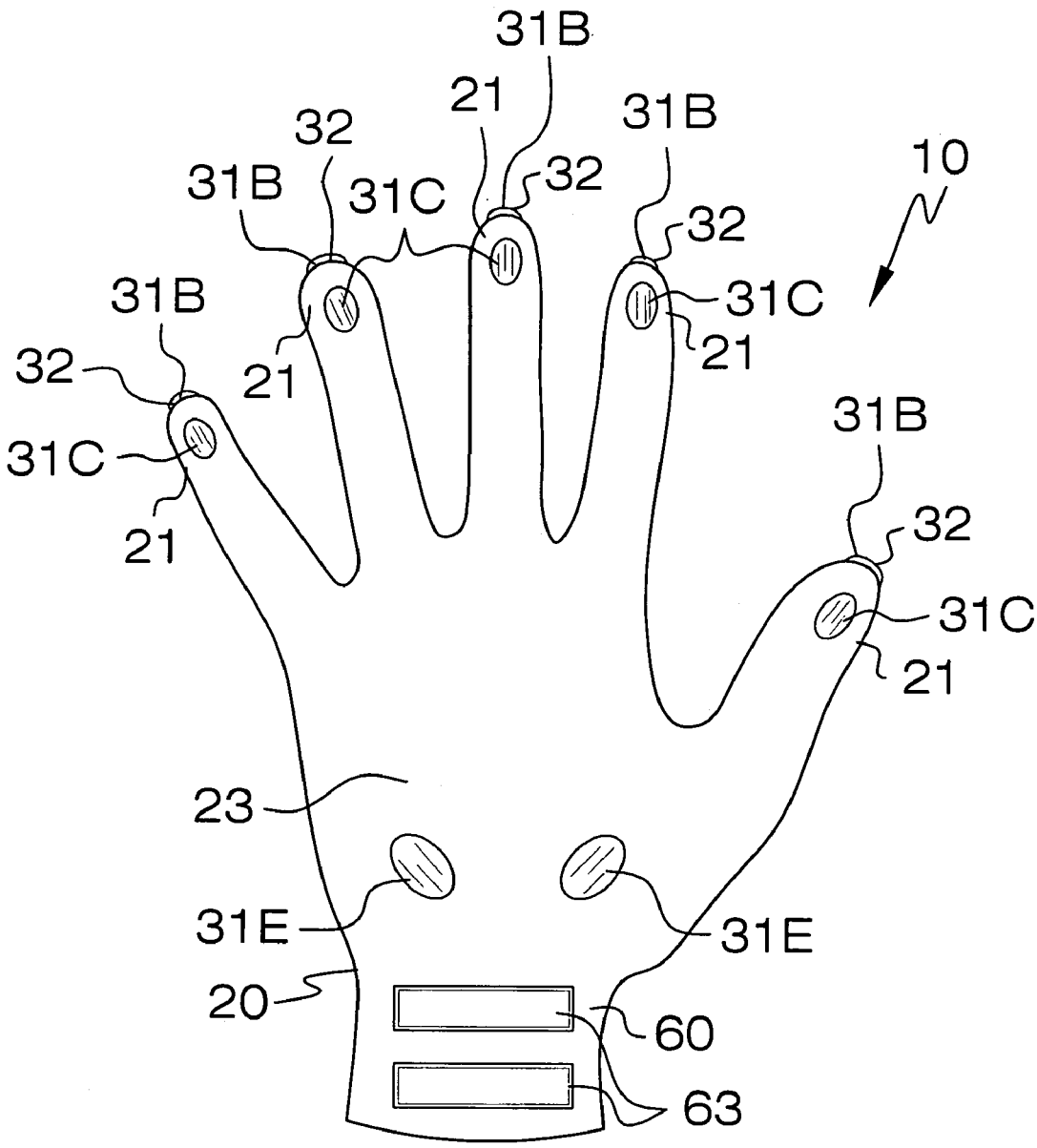
FIG. 2 is a bottom plan view of the device shown in FIG. 1, showing the palm sensors thereof.

Referring initially to FIGS. 1 and 2, the device 10 includes a body 20 that is removably positional about a hand of the user such that each finger of the user's hand is effectively able to freely move in multiple planes. Of course, the body 20 may be produced in a variety of different sizes such that the device 10 can be used by persons of all ages and sizes, as is obvious to a person of ordinary skill in the art. The device 10 can also be produced with a pair of bodies 20 for independently or simultaneously fitting on either or both hands of a user, respectively. Of course, the body 20 may be produced in a variety of alternate colors for corresponding to user's clothing, as is obvious to a person of ordinary skill in the art. The body 20 also includes a power supply source 24 embedded therein that is important for providing an operating power to the various electrical components (discussed herein below) of the device 10.

Referring to FIGS. 1, 2, 3 and 4, a mechanism 30 is included for sensing a plurality of external forces 11 on each of the user fingers. Such a sensing mechanism 30 is located partially external of the body 20. The external force sensing mechanism 30 includes a plurality of sensors 31 that include potentiometers 32 directly coupled, without the use of intervening elements, to fingers tips 21 of the body 20 in such a manner that each of the finger tips 21 includes first 31A, second 31B and third 31C ones of the sensors 31. Fourth ones 31D of the sensors 31 are located on knuckle regions 22 of the body 20, as is best shown in FIG. 1.

Fifth ones 31E of the sensors 31 are located on a palm region 23 of the body 20, which is important such that the user can simultaneously bias the finger tips 21 of the body 20 and directly contact, without the use of intervening elements, the first 31A, second 31B and third 31C ones of the sensors 31 with the fourth 31D and fifth 31E ones of the sensors 31 and thereby effectively modify the audible musical sounds accordingly. This feature advantageously allows a user to create a wide range of notes, rhythms and/or melodies with the device 10. Of course, the external force sensing mechanism 30 may have sensors 31 located at other positions along the body 20, like the surfaces between adjacent metacarpals, as is obvious to a person of ordinary skill in the art.

Figure 3:
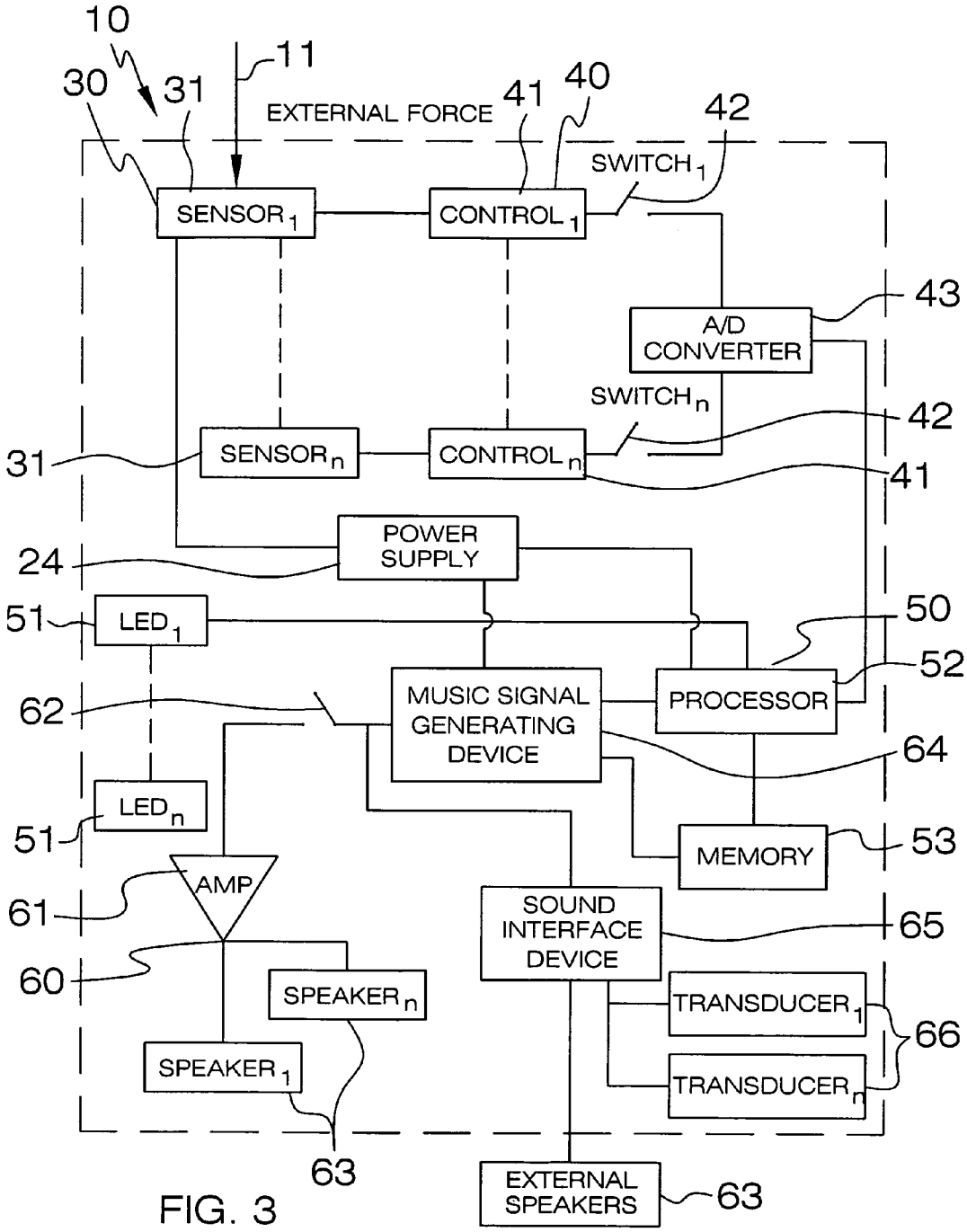
FIG. 3 is a schematic block diagram of the device shown in FIGS. 1 and 2.
Figure 4:
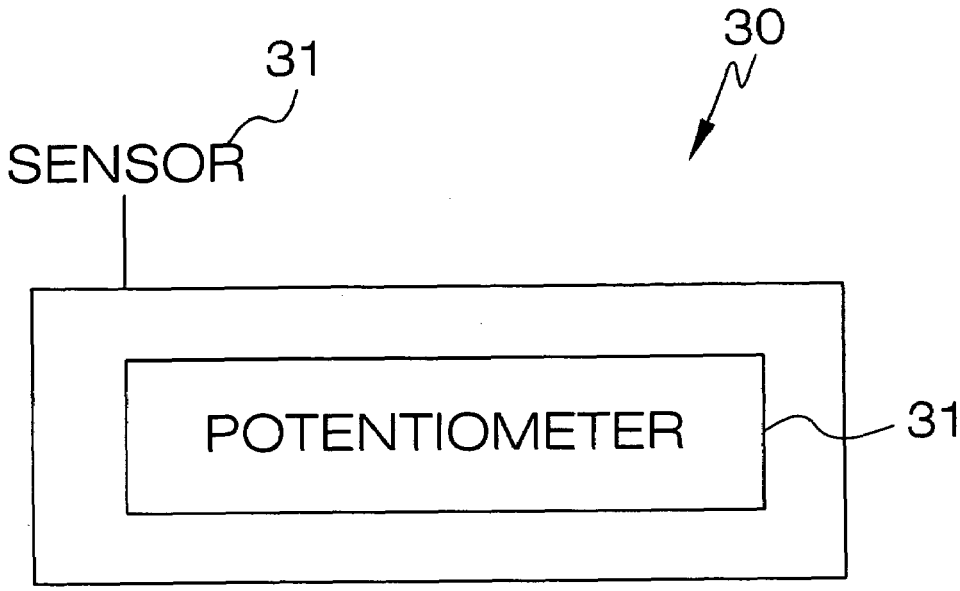
FIG. 4 is a schematic block diagram of the external force sensing mechanism shown in FIGS. 1 and 2.

Referring to FIG. 3, another mechanism 40 is included for sequentially generating a plurality of control signals when the sensing mechanism 30 detects the external forces 11. Each of the control signals includes an embedded digital data stream identifying an intensity and a time interval of the external forces 11 detected by the sensing mechanism 30.

The sequential generating mechanism 40 includes a plurality of controls 41 that are electrically coupled directly, without the use of intervening elements, to the sensors 31 respectively. A plurality of switches 42 are electrically coupled directly, without the use of intervening elements, to the controls 41 respectively. An analog-to-digital converter 43 is electrically coupled to the controls 41. Such an analog to digital converter 43 is crucial for effectively converting an analog wave pattern of the control signals to a digital numeric pattern corresponding to the digital data stream. Each of the controls 41 toggles the switches 42 between open and closed positions based upon detection of the intensity and time interval characteristics of the external forces 11 such that the control signals are sequentially coordinated with the external forces 11.

Referring to FIGS. 1 through 3, a further mechanism 50 is included for calculating a signal pattern corresponding to the control signal data streams. Such a signal pattern has identical intensity and time interval characteristics of the external forces 11. A plurality of LEDs 51 are electrically coupled to the signal pattern calculating mechanism 50. Such a signal pattern calculating mechanism 50 includes a digital signal processor 52 electrically coupled directly, without the use of intervening elements, to the analog to digital converter 43. A memory 53 includes software instructions that cause the digital signal processor 52 to compress groups of the digital data streams. Such software instructions execute a logic algorithm that includes the steps of identifying unique data packets from the digital data stream, grouping the unique data packets into separate batches, and storing the batches in retrievable memory zones such that the batches can advantageously and effectively be sequentially accessed during real-time playing conditions. Separating the data packets in batches is critical for allowing the digital signal processor to quickly group together similar sounds and movement patterns of the glove 10 during so that common sounds, rhythms, melodies, etc. can be learned by the present invention.

Referring to FIG. 3, a mechanism 60 is also included for emitting a plurality of audible musical sounds based upon the calculated signal pattern such that the audible musical sounds match the intensity and time interval of the signal pattern. This is an essential and advantageous feature for effectively permitting the user to adjust the audible musical sounds by controlling real time intensity and time intervals of the external forces 11 applied to the sensors respectively, which increases the range of notes that can be produced by the device 10. The audible musical sound emitting mechanism 60 includes an amp 61 and a switch 62 electrically coupled thereto. A plurality of speakers 63 are embedded within the body 20 and are directly coupled, without the use of intervening elements, to the amp 61.

The audible musical sound emitting mechanism 60 includes a musical signal generating device 64 that is electrically coupled to the memory 53. Such a musical signal generating device 64 is crucial for selectively extracting and uncompressing selected ones of the batches when corresponding ones of the external forces 11 are detected. A sound interface device 65 is electrically coupled directly, without the use of intervening elements, to the musical signal generating device 64 and directly receives, without the use of intervening elements, the uncompressed batches therefrom. A plurality of transducers 66 are electrically coupled to the sound interface device 65 and emits the audible musical sounds based upon unique sounds associated with the batches respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A glove worn by a user for generating and emitting musical sounds, notes, rhythms and melodies, said glove comprising:

a body removably positional about a hand of the user such that each finger of the user hand is able to freely move in multiple planes;

means for sensing a plurality of external forces on each of the user fingers, said sensing means being located partially external of said body;

means for sequentially generating a plurality of control signals when said sensing means detects said external forces, each of said control signals including an embedded digital data stream identifying an intensity and a time interval of said external forces detected by said sensing means;

means for calculating a signal pattern corresponding to said control signal data streams, said signal pattern having identical intensity and time interval characteristics of said external forces, a plurality of LEDs electrically coupled to said signal pattern calculating means; and means for emitting a plurality of audible musical sounds based upon said calculated signal pattern such that said audible musical sounds match the intensity and time interval of said signal pattern and thereby permit the user to adjust said audible musical sounds by controlling real time intensity and time intervals of said external forces applied to said sensors respectively.

2. The device of claim 1, wherein said external force sensing means comprises:

a plurality of sensors including potentiometers directly coupled to fingers tips of said body in such a manner that each of said finger tips includes first, second and third ones of said sensors;

wherein fourth ones of said sensors are located on knuckle regions of said body;

wherein fifth ones of said sensors are located on a palm region of said body such that the user can simultaneously bias said finger tips of said body and directly contact said first, second and third ones of said sensors with said fourth and fifth ones of said sensors and thereby modify said audible musical sounds accordingly.

3. The device of claim 1, wherein said sequential generating means comprises:

a plurality of controls electrically coupled directly to said sensors respectively;

a plurality of switches electrically coupled directly to said controls respectively; and an analog-to-digital converter electrically coupled to said controls, said analog to digital converter converting an analog wave pattern of said control signals to a digital numeric pattern corresponding to said digital data stream;

each of said controls toggling said switches between open and closed positions based upon detection of said intensity and time interval characteristics of said external forces such that said control signals are sequentially coordinated with said external forces.

4. The device of claim 1, wherein said signal pattern calculating means comprises:

a digital signal processor electrically coupled directly to said analog to digital converter;

a memory including software instructions that cause said digital signal processor to compress groups of said digital data streams, said software instructions executing a logic algorithm including the steps of a. identifying unique data packets from said digital data stream, b. grouping said unique data packets into separate batches, and c. storing said batches in retrievable memory zones such that said batches can be sequentially accessed during real-time playing conditions.

5. The device of claim 1, wherein said audible musical sound emitting means comprises:

a musical signal generating device electrically coupled to said memory, said musical signal generating device selectively extracting and uncompressing selected ones of said batches when corresponding ones of said external forces are detected;

a sound interface device electrically coupled directly to said musical signal generating device and directly receiving said uncompressed batches therefrom; and a plurality of transducers electrically coupled to said sound interface device and emitting said audible musical sounds based upon unique sounds associated with said batches respectively.

6. A glove worn by a user for generating and emitting musical sounds, notes, rhythms and melodies, said glove comprising:

a body removably positional about a hand of the user such that each finger of the user hand is able to freely move in multiple planes;

means for sensing a plurality of external forces on each of the user fingers, said sensing means being located partially external of said body;

means for sequentially generating a plurality of control signals when said sensing means detects said external forces, each of said control signals including an embedded digital data stream identifying an intensity and a time interval of said external forces detected by said sensing means;

means for calculating a signal pattern corresponding to said control signal data streams, said signal pattern having identical intensity and time interval characteristics of said external forces, a plurality of LEDs electrically coupled to said signal pattern calculating means; and means for emitting a plurality of audible musical sounds based upon said calculated signal pattern such that said audible musical sounds match the intensity and time interval of said signal pattern and thereby permit the user to adjust said audible musical sounds by controlling real time intensity and time intervals of said external forces applied to said sensors respectively;

wherein audible musical sound emitting means comprises an amp and a switch electrically coupled thereto, a plurality of speakers embedded within said body and directly coupled to said amp.

7. The device of claim 6, wherein said external force sensing means comprises:

a plurality of sensors including potentiometers directly coupled to fingers tips of said body in such a manner that each of said finger tips includes first, second and third ones of said sensors;

wherein fourth ones of said sensors are located on knuckle regions of said body;

wherein fifth ones of said sensors are located on a palm region of said body such that the user can simultaneously bias said finger tips of said body and directly contact said first, second and third ones of said sensors with said fourth and fifth ones of said sensors and thereby modify said audible musical sounds accordingly.

8. The device of claim 6, wherein said sequential generating means comprises:

a plurality of controls electrically coupled directly to said sensors respectively;

a plurality of switches electrically coupled directly to said controls respectively; and an analog-to-digital converter electrically coupled to said controls, said analog to digital converter converting an analog wave pattern of said control signals to a digital numeric pattern corresponding to said digital data stream;

each of said controls toggling said switches between open and closed positions based upon detection of said intensity and time interval characteristics of said external forces such that said control signals are sequentially coordinated with said external forces.

9. The device of claim 6, wherein said signal pattern calculating means comprises:

a digital signal processor electrically coupled directly to said analog to digital converter;

a memory including software instructions that cause said digital signal processor to compress groups of said digital data streams, said software instructions executing a logic algorithm including the steps of a. identifying unique data packets from said digital data stream, b. grouping said unique data packets into separate batches, and c. storing said batches in retrievable memory zones such that said batches can be sequentially accessed during real-time playing conditions.

10. The device of claim 6, wherein said audible musical sound emitting means comprises:

a musical signal generating device electrically coupled to said memory, said musical signal generating device selectively extracting and uncompressing selected ones of said batches when corresponding ones of said external forces are detected;

a sound interface device electrically coupled directly to said musical signal generating device and directly receiving said uncompressed batches therefrom; and a plurality of transducers electrically coupled to said sound interface device and emitting said audible musical sounds based upon unique sounds associated with said batches respectively.

* * * * *